US006213062B1

(12) United States Patent
Kawase

(10) Patent No.: US 6,213,062 B1
(45) Date of Patent: Apr. 10, 2001

(54) COOLING SYSTEM FOR ENGINE WITH SUPERCHARGER

(75) Inventor: Shuichi Kawase, Shizuoka-ken (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 09/377,808

(22) Filed: Aug. 20, 1999

(30) Foreign Application Priority Data

Aug. 31, 1998 (JP) ..... 10-260985

(51) Int. Cl.[7] ..... F02B 39/00
(52) U.S. Cl. ..... 123/41.31
(58) Field of Search ..... 123/41.31, 41.54; 417/407; 60/605; 165/104.32

(56) References Cited

U.S. PATENT DOCUMENTS

| | | | | |
|---|---|---|---|---|
| 4,061,187 | * | 12/1977 | Rajasekaran et al. | 123/41.54 |
| 4,561,387 | * | 12/1985 | Korkemeier et al. | 123/41.31 |
| 4,608,827 | | 9/1986 | Hasegawa et al. | 123/41.31 |
| 4,649,869 | * | 3/1987 | Hayashi et al. | 123/41.21 |
| 4,928,637 | | 5/1990 | Naitoh et al. | 123/41.31 |
| 5,111,776 | * | 5/1992 | Matsushiro et al. | 123/41.54 |
| 5,329,889 | * | 7/1994 | Caldwell | 123/41.54 |

FOREIGN PATENT DOCUMENTS

| | | |
|---|---|---|
| 2-52091 | 11/1990 | (JP) . |
| 6-3143 | 1/1994 | (JP) . |
| 6-37531 | 5/1994 | (JP) . |
| 6-76622 | 10/1994 | (JP) . |
| 7-4841 | 1/1995 | (JP) . |
| 8-2434 | 1/1996 | (JP) . |

* cited by examiner

*Primary Examiner*—Noah P. Kamen
*Assistant Examiner*—Hyder Ali
(74) *Attorney, Agent, or Firm*—Flynn, Thiel, Boutell & Tanis, P.C.

(57) ABSTRACT

A cooling system for an engine with a supercharger is designed to reliably prevent seizing of the supercharger during an engine-soaking period. To this end, a cooling system for an engine with a supercharger includes a main cooling system for cooling the engine and a sub-cooling system for cooling the supercharger. The sub-cooling system is positioned alongside the main cooling system. The sub-cooling system includes cooling piping for cooling the supercharger and a tank for temporarily reserving cooling water. The tank is disposed substantially midway along the cooling piping at a location above a position where the supercharger is mounted.

18 Claims, 9 Drawing Sheets

COOLING SYSTEM FOR ENGINE WITH SUPERCHARGER

FIELD OF THE INVENTION

This invention relates to a cooling system for an engine with a supercharger. More particularly, it relates to a cooling system designed to reliably prevent seizing of the supercharger during an engine-soaking period.

BACKGROUND OF THE INVENTION

There is an engine of the type having a supercharger provided therein (which supercharger is also referred to as a "turbocharger" or simply called a "turbo"). The supercharger causes exhaust gases from the engine to rotate a turbine. Then, a compressor, which is coaxially aligned with the turbine, supplies intake air under pressure to the engine.

The engine is provided with a main cooling system and a sub-cooling system. The former system cools the engine, while the latter does, e.g., the supercharger. The sub-cooling system is positioned alongside the main cooling system.

One example of a cooling system for the above engine with the supercharger is disclosed in published Japanese Examined Patent Application No. 2-52091. The cooling system for an internal combustion engine with a turbocharger can cool a bearing portion, even after the engine is deactivated. In addition, the cooling system has an increased amount of freedom in positioning of the turbocharger. Further, the cooling system facilitates replenishment of cooling water to an engine cooling system. Moreover, the cooling system is designed to promote the warm-up of the turbocharger, and further to reduce a load on a cooling pump.

Another example is disclosed in published Japanese Examined Patent Application No. 6-3143. A cooling system for an internal combustion engine with a turbocharger includes an engine cooling water-circulating circuit and a turbocharger cooling water-circulating circuit. The former circuit is formed between a water pump for the engine, a water jacket formed in the engine, and a radiator, while the latter circuit is formed between a water jacket for the turbocharger, a water-filling tank, and a water pump. The water jacket for the turbocharger is branched off from the above engine water jacket in communication therewith. The water-filling tank is positioned higher than the turbocharger. The water-filling tank has a water level set higher than a degassing portion of the radiator at an upper portion thereof. The cooling system is characterized by: an air chamber positioned in the water-filling tank at an upper portion thereof, the air chamber being communicated to a distal end of a cooling water outlet pipe, the cooling water outlet pipe being connected to a cooling water outlet of the above turbocharger water jacket, a cooling water return pipe, through which the aforesaid cooling water outlet and the intake side of the water pump are communicated to one another at the bottom of the tank, the cooling water outlet being open below the water level of the tank, a one-way valve designed to open only in an internal tank direction, the one-way valve being provided at an outlet opening of a degassing passage, the outlet opening being open above the water level of the tank, and a degassing pipe connected to a degassing portion of the radiator at the top portion thereof, the degassing pipe being communicated to the degassing passage through the one-way valve. This invention provides smooth movements of steam that are generated in the water jacket for the turbocharger during engine stop, and further permits the generated steam to promote circulation of the cooling water in the turbocharger cooling water-circulating circuit.

A further example is disclosed in published Japanese Examined Model Utility Application No. 8-2434. In a cooling system for a supercharger for use on an internal combustion engine, a housing covering a bearing portion of the supercharger is positioned higher than a liquid level of cooling water in a radiator. The cooling water is introduced into a cooling water passage in the housing, thereby cooling the bearing portion. The cooling system is characterized by: a cooling water supply passage, through which the cooling water passage in the housing is communicated to either the discharge side of a water pump or a cylinder block; a return passage through which the cooling water passage is communicated to either the intake side of the water pump or the radiator; a reservoir tank for use on the supercharger, which tank is communicated to a cooling water passage in the supercharger, the reservoir tank being positioned higher than the housing, the above supercharger reservoir tank and a reservoir tank for use on the radiator being communicated to one another through a cap for use on the supercharger; a valve for releasing pressure in the supercharger reservoir tank to the above radiator reservoir tank when the internal pressure of the supercharger reservoir tank exceeds a predetermined value, the valve being provided on the above supercharger cap; a valve for introducing cooling water into the supercharger reservoir tank from the radiator reservoir tank when the internal pressure of the supercharger reservoir tank falls below the predetermined value, the valve being provided on the supercharger cap. This invention can introduce the cooling water into the housing, thereby providing an improved cooling efficiency, even when the housing for the supercharger is positioned higher than the liquid level of the cooling water in the radiator.

A yet further example is disclosed in published Japanese Unexamined Model Utility Application No. 6-76622. In a cooling system for a supercharger for use on an internal combustion engine as disclosed in this publication, a center housing covering a journal portion of the supercharger is positioned higher than a water level of cooling water in a radiator. Some cooling water circulating in an engine cooling water circulation system is introduced into a cooling water passage in the center housing, thereby cooling the journal portion. The radiator is disposed substantially midway along the engine cooling water circulation system. A reservoir tank communicated to the cooling water passage in the center housing is positioned higher than the center housing. The reservoir tank is communicated to the radiator through a pressurization cap. The reservoir tank is communicated to an inlet port of a water pump in the engine cooling water circulation system. The pressurization cap is provided with a valve that is opened for releasing the inner pressure of the reservoir tank to the radiator when the internal pressure of the reservoir tank is greater than a predetermined pressure. The cooling system is characterized in that the valve of the pressurization cap has a valve opening pressure set to be 0.7 kg/cm2 or less. This invention controls a rise in temperature inside the center housing of the supercharger immediately after the engine is deactivated.

Other cooling systems for an engine having a supercharger incorporated therein are disclosed in published Japanese Unexamined Utility Model Applications 6-37531 and 7-4841.

In conventional cooling systems for an engine with a supercharger, there is one system of the type as illustrated in FIGS. 11 and 12. That is, a single hose 126 connects a thermocase 118 and a supercharger 112 in communication with one another. The thermocase 118 is attached to a cylinder head 106 of an engine 102. Cooling water flows from the thermocase 118 toward the supercharger 112 as shown by the arrows in FIG. 12.

As seen from FIG. 11, the hose 126 is positioned in front of an exhaust manifold 114. This layout has advantages in that the piping can be laid at the shortest distance, and further that there exists no substantial difference in height between the hose 126 and the exhaust manifold 114. However, in this layout, such piping presupposes the absence of any obstacle in front of the exhaust manifold 114.

In fact, an obstacle is usually present in front of the exhaust manifold 114, and the hose 126 cannot be placed in front of the exhaust manifold 114. Therefore, there has been a continuing desire for an improved method.

By way of a countermeasure to obviate the aforesaid inconvenience, a hose 226 (FIGS. 13 and 14) has an intermediate pipe 242 incorporated therein and located substantially midway along the hose 226. The hose 226 intercommunicates a thermocase 218 and a supercharger 212. The thermocase 218 is fitted to a cylinder head 206 of an engine 202.

As illustrated in FIGS. 13 and 14, in this piping structure, the intermediate pipe 242 bypasses an exhaust manifold 214, and is instead laid through an upper portion of the exhaust manifold 214. A bracket supports the intermediate pipe 242 onto the cylinder head cover. Cooling water flows from the thermocase 218 toward the supercharger 212 as shown by the arrows in FIG. 14.

In this case, however, there are differences in height along the piping. As a result, air (steam) is generated in the supercharger 212 at an engine-soaking period, and is then lodged in the intermediate pipe 242.

Such stagnant air (steam) causes airlock in a sub-cooling system for use on a supercharger. The occurrence of the airlock fails to feed sufficient cooling water into the supercharger, with consequential seizure of the supercharger.

SUMMARY OF THE INVENTION

In order to minimize or obviate the above inconveniences, the present invention provides a cooling system for an engine with a supercharger, including a main cooling system for cooling the engine and a sub-cooling system for use on the supercharger. The sub-cooling system is disposed alongside the main cooling system. The improvement comprises cooling piping for cooling the supercharger and a tank for temporarily reserving cooling water. The tank is disposed substantially midway along the cooling piping at a location above a position where the supercharger is mounted.

Pursuant to the above invention, air (steam) occurring in the supercharger during an engine-soaking period brings the cooling water out of the tank into the supercharger. As a result, the supercharger is reliably prevented from experiencing seizing.

DETAILED DESCRIPTION OF THE INVENTION

Embodiments of the present invention will now be described in detail with reference to the drawings.

Figure 1:
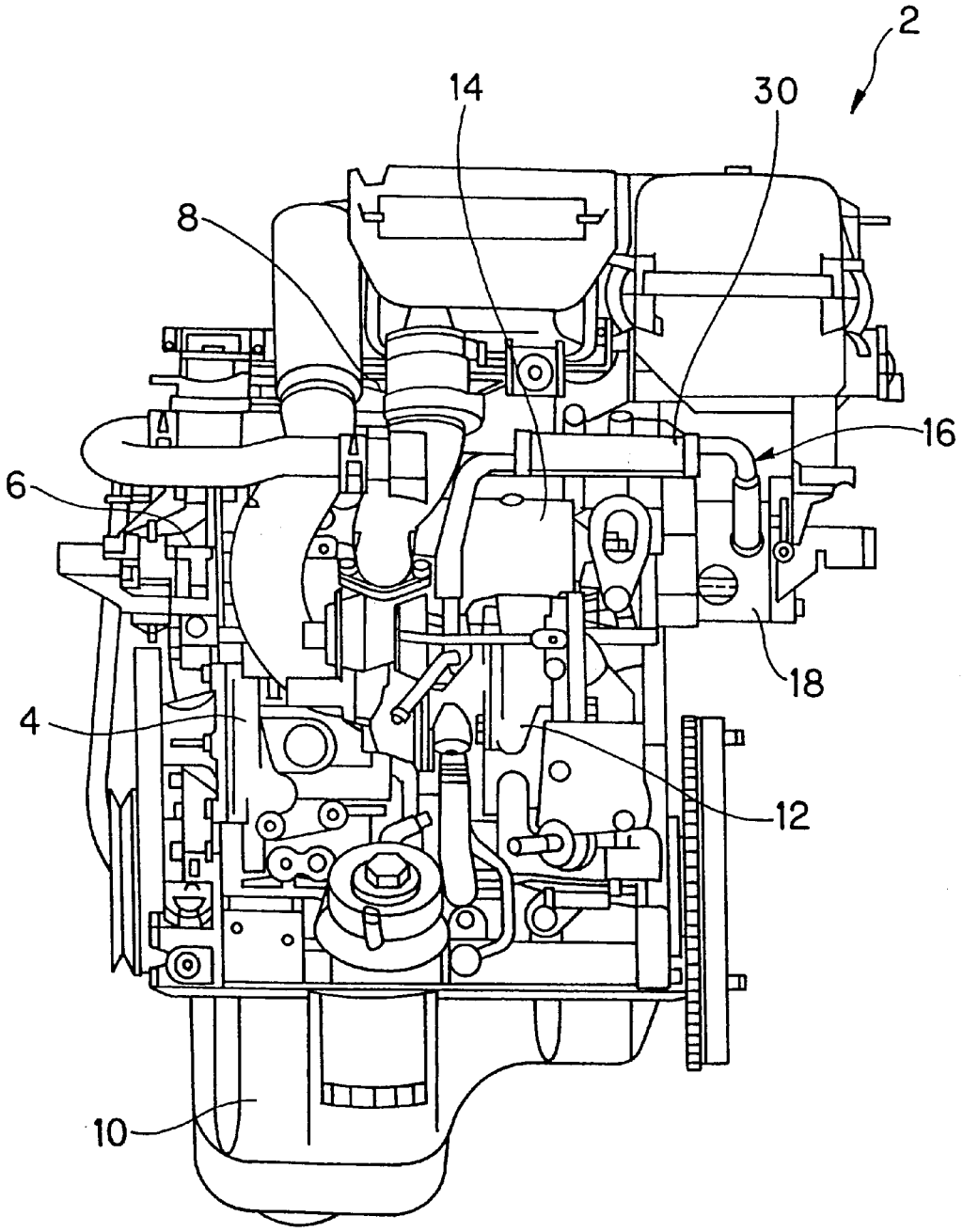
FIG. 1 is a front view showing an engine with a supercharger according to one embodiment of this invention.

FIGS. 1–7 illustrate one embodiment of the present invention. In FIG. 1, reference numeral 2 denotes an engine with a supercharger (hereinafter simply called an "engine").

The engine 2 includes a cylinder block 4, a cylinder head 6, a cylinder head cover 8, and an oil pan 10. The cylinder head 6 is attached to an upper surface of the cylinder block 4. The cylinder head cover 8 is fitted to an upper surface of the cylinder head 6. The oil pan 10 is fitted to the underside of the cylinder block 4.

The engine 2 has a supercharger 12 (also referred to as a "turbocharger" or simply a "turbo") provided therein. As illustrated in FIG. 1, the supercharger 12 is positioned below an exhaust manifold 14 on the front side of the engine 2.

Figure 2:
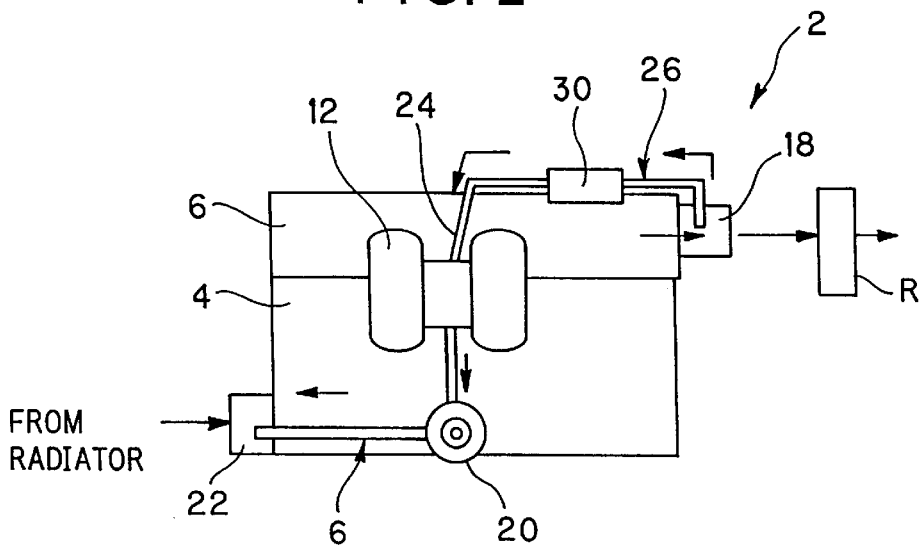
FIG. 2 is a schematic front view of the engine showing a direction in which cooling water represented by arrows flows during engine operation.

The engine 2 is further provided with a main cooling system for cooling the engine 2 and a sub-cooling system for use on the supercharger 12. The main cooling system includes a radiator R as shown in FIG. 2. The sub-cooling system is arranged side by side with the main cooling system.

The sub-cooling system is provided with cooling piping 16 for cooling the supercharger 12. Referring to FIG. 2, the cooling piping 16 is shown establishing communication between a thermocase 18 attached to the cylinder head 6, the supercharger 12, an oil cooler 20, and a water pump 22. The water pump 22 receives cooling water or coolant from the radiator R.

The thermocase 18 and the supercharger 12 are communicated to one another through a hose 26. The hose 26 is part of a cooling water passage 24.

Figure 5:
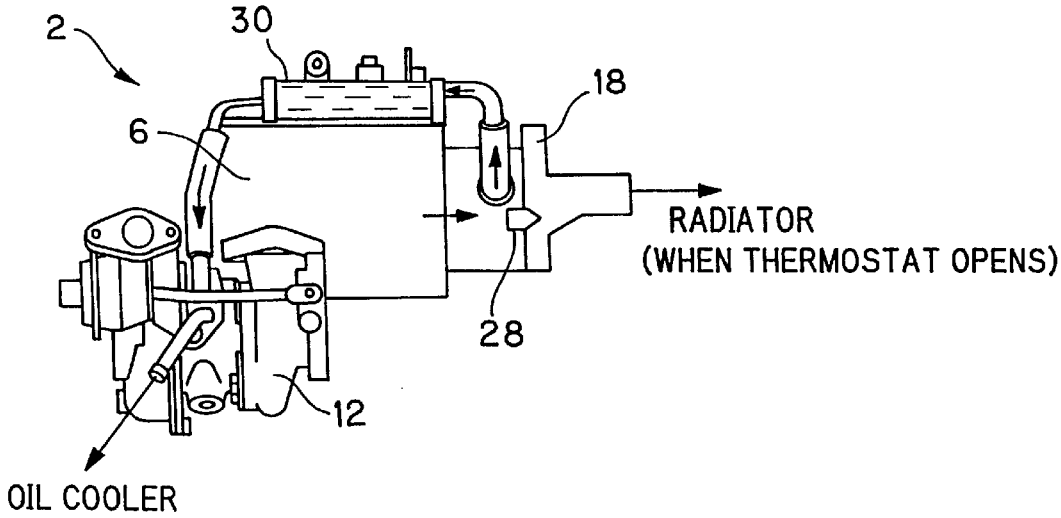
FIG. 5 is a schematic enlarged front view of the engine, showing a level of the cooling water in the tank during engine operation.

As illustrated in FIG. 5, the thermocase 18 has a thermostat 28 disposed therein. When the thermostat 28 is opened, then cooling water in the thermocase 18 is caused to flow into a radiator R.

A tank 30 for temporarily storing the cooling water is provided substantially midway along the cooling pipe 16 at a location above a position where the supercharger 12 is mounted.

Figure 4:
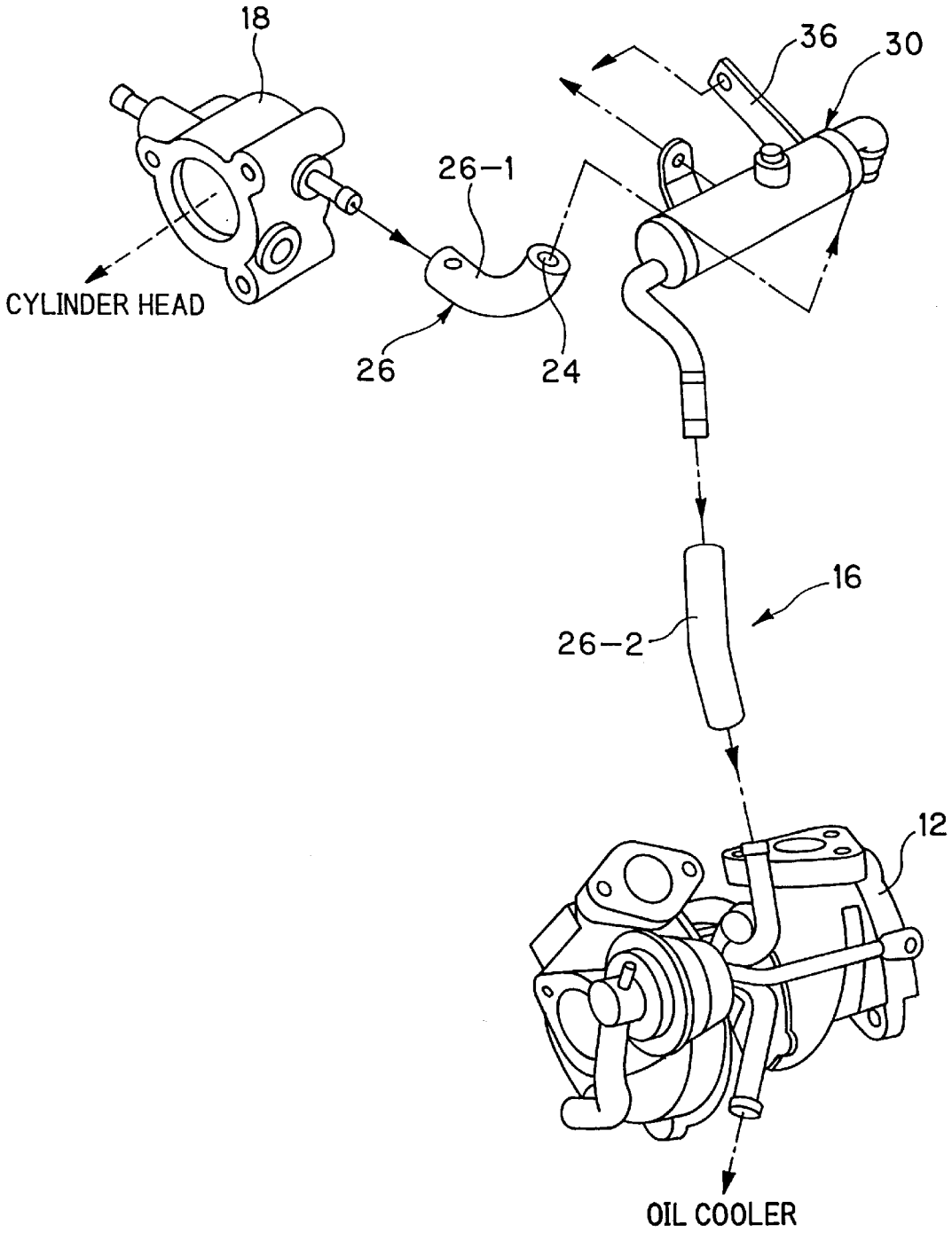
FIG. 4 is a schematic perspective view illustrating an assembly of cooling piping in FIG. 1.

In greater detail, while the thermocase 18 and the supercharger 12 are communicated together through the aforesaid hose 26, the tank 30 is provided substantially midway along the hose 26 at a position upward from the position where the supercharger 12 is mounted, as shown FIGS. 1 and 4.

As seen from FIG. 4, the hose 26 is divided into two parts: a first upstream side hose 26-1 communicated to the thermocase 18; and a second downstream side hose 26-2 communicated to the supercharger 12. The tank 30 is positioned between the first and second hoses 26-1, 26-2. Further, the tank 30 is ultimately disposed at the top most position of the cooling piping 16. The tank 30 has an opening 32 through which air is discharged out of the tank 30.

The tank 30 includes a hollow cylindrical tank body portion 30-1, a first inlet side pipe 30-2, and a second outlet side pipe 30-3. The tank body portion 30-1 has a capacity to store some 40 cubic centimeters of cooling water or coolant. In addition, the tank body portion 30-1 includes a cylindrical member whose both ends are plugged. The first and second pipes 30-2, 30-3 are connected to the tank body portion 30-1. The first and second pipes 30-2, 30-3 form respective parts of the cooling piping 16. In addition, the second pipe 30-3, which is located toward the supercharger 12, is mounted on the tank body portion 30-1 at the bottommost position thereof in a state of establishing communication between the second pipe 30-3 and the bottommost position of the tank body portion 30-1. Cooling water flows from thermocase 18, through the cooling piping 16, to the supercharger 12. Further, cooling water from the supercharger 12 in FIG. 4 is received by an oil cooler (not shown).

Figure 3:
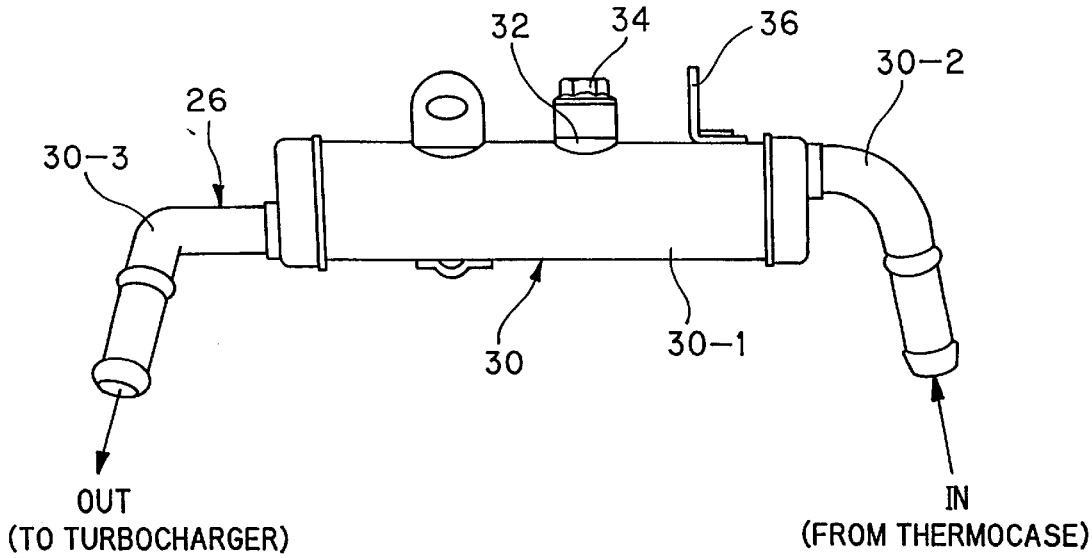
FIG. 3 is an enlarged illustration showing the tank of FIG. 1.

More specifically, as illustrated in FIG. 3, the tank body portion 30-1 is formed with the opening 32 for degassing at an upper portion thereof. The opening 32 is plugged up with a drain bolt 34, located upwardly at the top of the tank body portion 30-1.

In the tank 30, the first pipe 30-2 is attached to the tank body portion 30-1 at an inlet side end portion thereof (at the right in FIG. 3) and at an upper position thereof. The first pipe 30-2 receives cooling water from thermocase 18. The second pipe 30-3 sends cooling water to the supercharger 12. The second pipe 30-3 is fitted to the tank body portion 30-1 at an outlet side end portion thereof (at the left in FIG. 3) and at a lower position thereof.

In this connection, reference numeral 36 denotes a mounting arm portion fitted to the tank body portion 30-1 for mounting the tank 30 onto the cylinder head cover 8.

Figure 6:
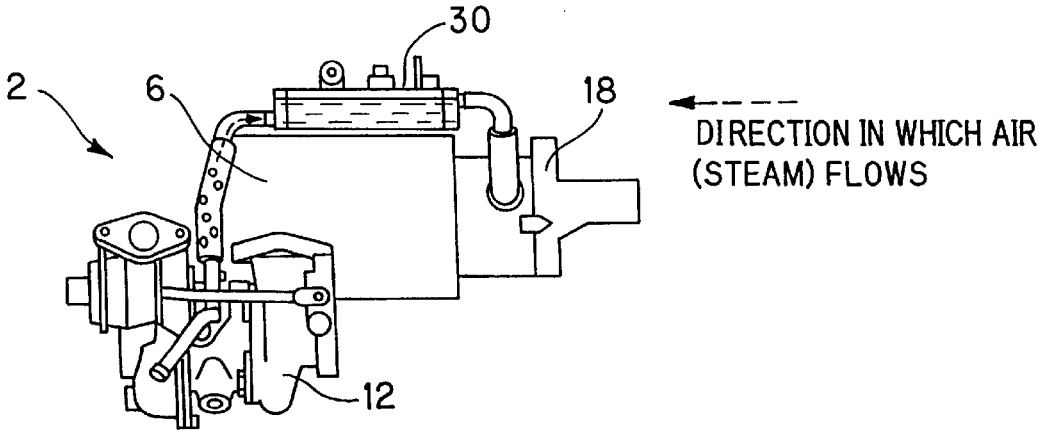
FIG. 6 is a schematic enlarged front view of the engine showing a level or state of the cooling water in the tank during an engine-soaking period (in the process of air generation)

The operation of the present embodiment will now be described. In FIGS. 5 and 6, solid arrows represent the direction cooling water flows and dashed line arrows represent the direction in which air (steam) flows.

Initially, cooling water of some 40 cubic centimeters is held in the tank 30 as shown in FIG. 5. Then the engine 2 is activated and cooling water flows through pipe 30-2 to tank 30 during engine operation. When thermostat 28 opens a valve (not shown), cooling water flows through the thermocase 18 to the radiator.

As shown in FIG. 6, air (steam) generated in the supercharger 12 during an engine-soaking period (in the process of air generation) after engine deactivation or shutdown is drawn upwardly into the tank 30 through both of the second downstream side hose 26-2 and the second outlet side pipe 30-3. The air (steam) then blows the cooling water out of the tank body portion 30-1 into the supercharger 12. The cooling water is thereby supplied to the supercharger 12.

In this way, the supercharger 12 is supplied with the cooling water from the tank 30 by means of the air (steam), and the supercharger 12 is thereby prevented from undergoing seizing.

Figure 7:
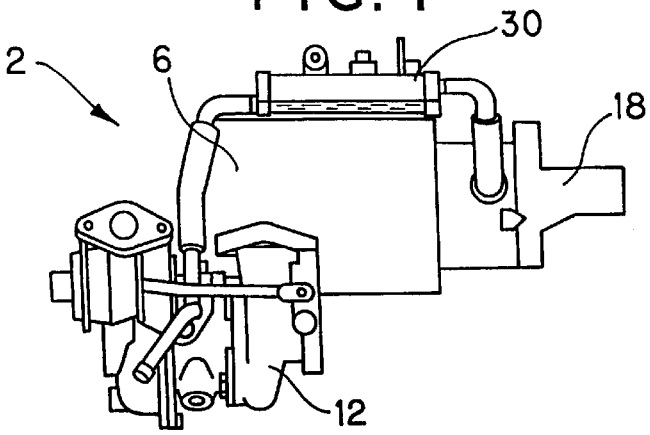
FIG. 7 is a schematic enlarged front view of the engine showing a level of the cooling water in the tank during the engine-soaking period (termination of air generation)

Then, as shown in FIG. 7, the air (steam) is lodged in the tank 30 during the engine-soaking period (termination of air generation).

Further, when the engine 2 is run to circulate the cooling water, then the air (steam) residing in the tank 30 is discharged through either a radiator cap (not shown) or a reservoir tank (not shown).

In addition, the opening 32 for degassing and the drain bolt 34, both of which are provided on the tank body portion 30-1 at the upper portion thereof, as shown in FIG. 3, are used for renewing the cooling water. The drain bolt 34 is backed off to avoid lodging air in the tank body portion 30-1, thereby permitting a specified amount of cooling water to be fed into the tank 30.

Thus, the air (steam) generated in the supercharger 12 during the engine-soaking period thrusts the cooling water out of the tank body portion 30-1 toward the supercharger 12. As a result, the supercharger 12 is securely prevented from experiencing seizing or other damage from overheating of the supercharger.

Further, the tank 30 can securely and easily be degassed because the tank 30 is provided at the topmost position of the cooling piping 16, and further because the tank 30 includes the opening 32. In addition, the tank 30 can contain a specified amount of cooling water. Moreover, a simpler structure, which is easy to produce and is maintained at low cost, is achievable.

In the first and second pipes 30-2, 30-3 communicated to the tank body portion 30-1, the second pipe 30-3 located toward the supercharger 12 is provided at the bottommost position of the tank body portion 30-1 in a state of being communicated to the bottommost position of the tank body portion 30-1. This construction allows the cooling water in the tank 30 to efficiently flow into the supercharger 12. As a result, the cooling water of some 40 cubic centimeters reserved in the tank 30 can be used efficiently without the remainder staying in the tank 30.

The present invention is not limited to the above, but is susceptible to various changes and modifications.

For example, in another embodiment of the present invention, the tank 30 for temporarily storing the cooling water is disposed substantially midway along the cooling piping 16 high above the position where the supercharger 12 is provided. In addition, the tank body portion 30-1 includes a cylindrical member whose both ends are plugged, thereby forming a hollow cylindrical configuration. The cylindrical member has a capacity to reserve some 40 cubic centimeters of cooling water.

Figure 8:
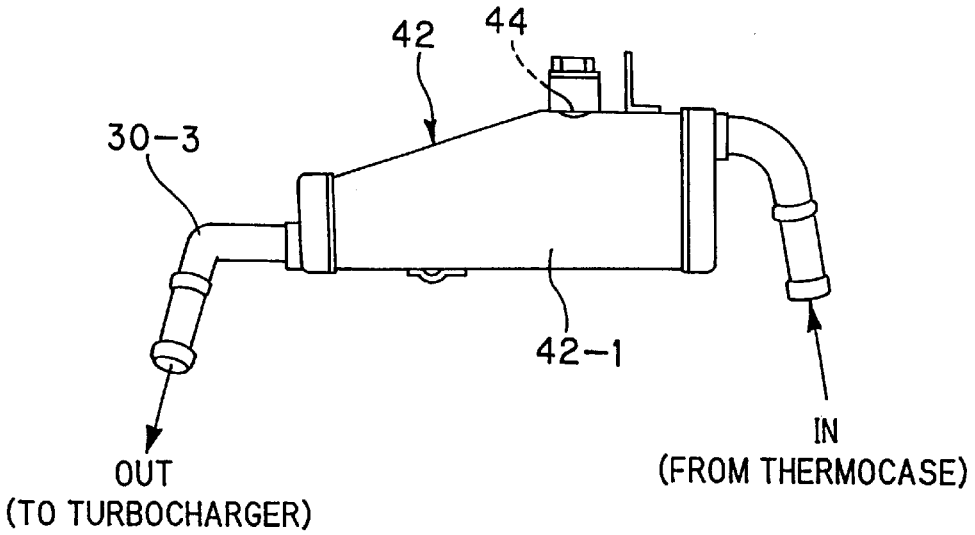
FIG. 8 is an enlarged illustration showing a tank according to another embodiment of the invention.

Alternatively, a tank 42 having a structure as illustrated in FIG. 8 may be provided. More specifically, the structure includes a tank body portion 42-1 and an opening 44 for air removal. The tank body portion 42-1 has a configuration such that a height position of the tank 42 on an upper surface thereof is greater on the upstream side of the tank 42, while the above height position is made smaller in stages from the upstream side to the downstream side of the tank 42. The opening 44 is provided at an upstream and upward portion of the tank 42 whose height position is greater.

This structure allows for an increase in storage capacity of the tank 42, thereby supplying the supercharger 12, with a greater amount of cooling water. As a result, it is possible to reliably prevent seizing of the supercharger 12. In addition, since the opening 44 for degassing is provided at the upstream portion of the tank 42 and at a location where the height of the tank is greater, the tank 42 can be degassed more reliably and readily. Further, since the air (steam) occurring in the supercharger during the engine-soaking period is collected at the upstream portion of the tank 42, the air is dislodged through a second outlet side pipe 30-3, thereby smoothly driving the cooling water out of the tank 42 into the supercharger.

Although the cooling system according to the embodiment of one aspect of the present invention includes a single tank, a further alternative structure may be employed, in which a plurality of tanks, e.g., two of first and second tanks 52, 54 are provided.

Figure 9:
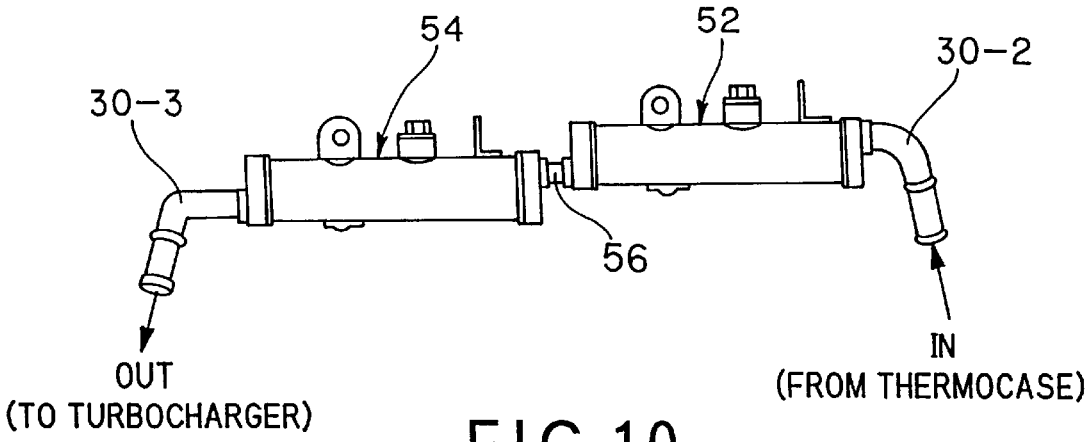
FIG. 9 is an enlarged illustration showing a tank according to yet another embodiment of the invention.

More specifically, as shown in FIG. 9, when the first and second tanks 52, 54 having respective predetermined capacities are provided substantially midway along the cooling piping 16, a first inlet side pipe 30-2 is connected to the first tank 52 on the upstream side thereof. The second tank 54, which is smaller in height position than the first tank 52, is positioned downstream from the first tank 52. A connection pipe 56 connects the bottommost position of the first tank 52 to the upstream side of the second tank 54. The second pipe 30-3 is connected to the second tank 54 on the downstream side thereof and at the bottommost position thereof.

As a result, the cooling water temporarily stored in the first and second tanks 52, 54 can be supplied to the supercharger, and seizing of the supercharger can securely be prevented. In addition, a storage quantity of cooling water can readily be increased and decreased according to the number of the tanks having respective predetermined capacities. Further, settings and liquid capacity of the tanks 52, 54 utilized, can arbitrarily be changed according to the size of the engine with the supercharger.

Figure 10:
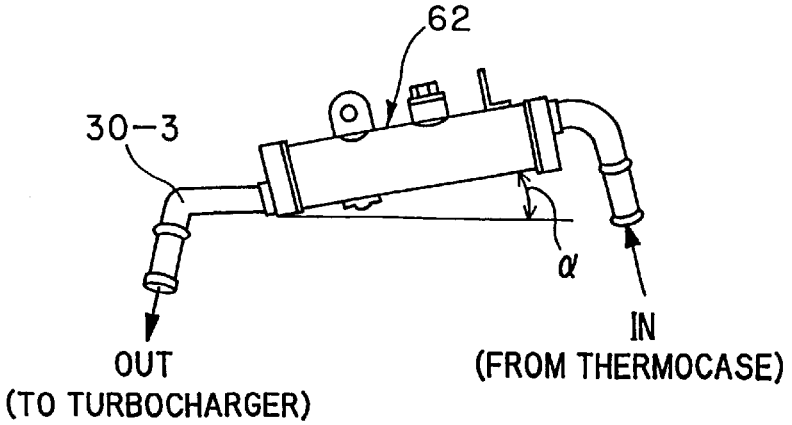
FIG. 10 is an enlarged illustration showing a tank according to a further embodiment of the invention.
Figure 11:
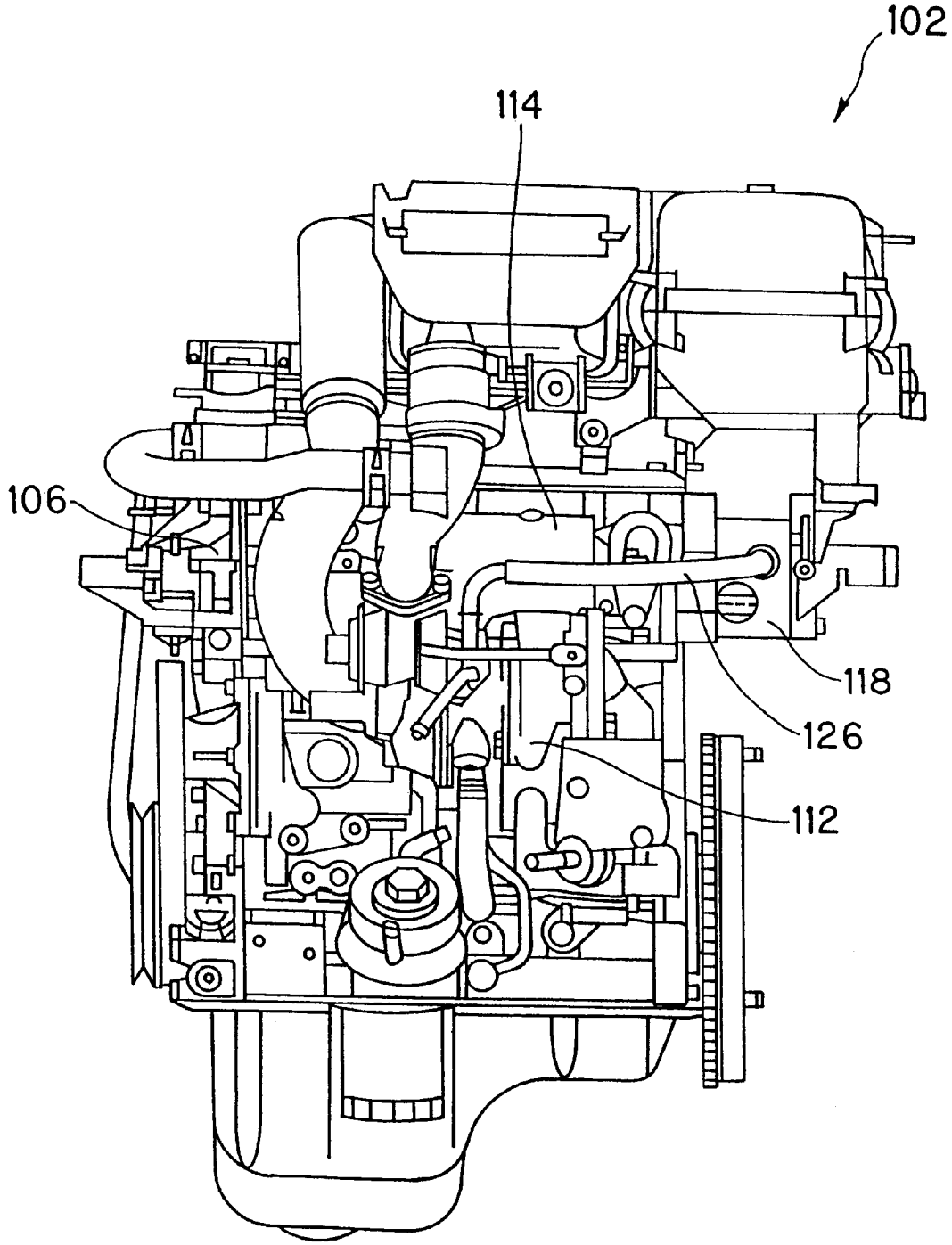
FIG. 11 (PRIOR ART)
FIG. 11 is a front view illustrating an engine with a supercharger according to a first example of the prior art that underlies the present invention.
Figure 12:
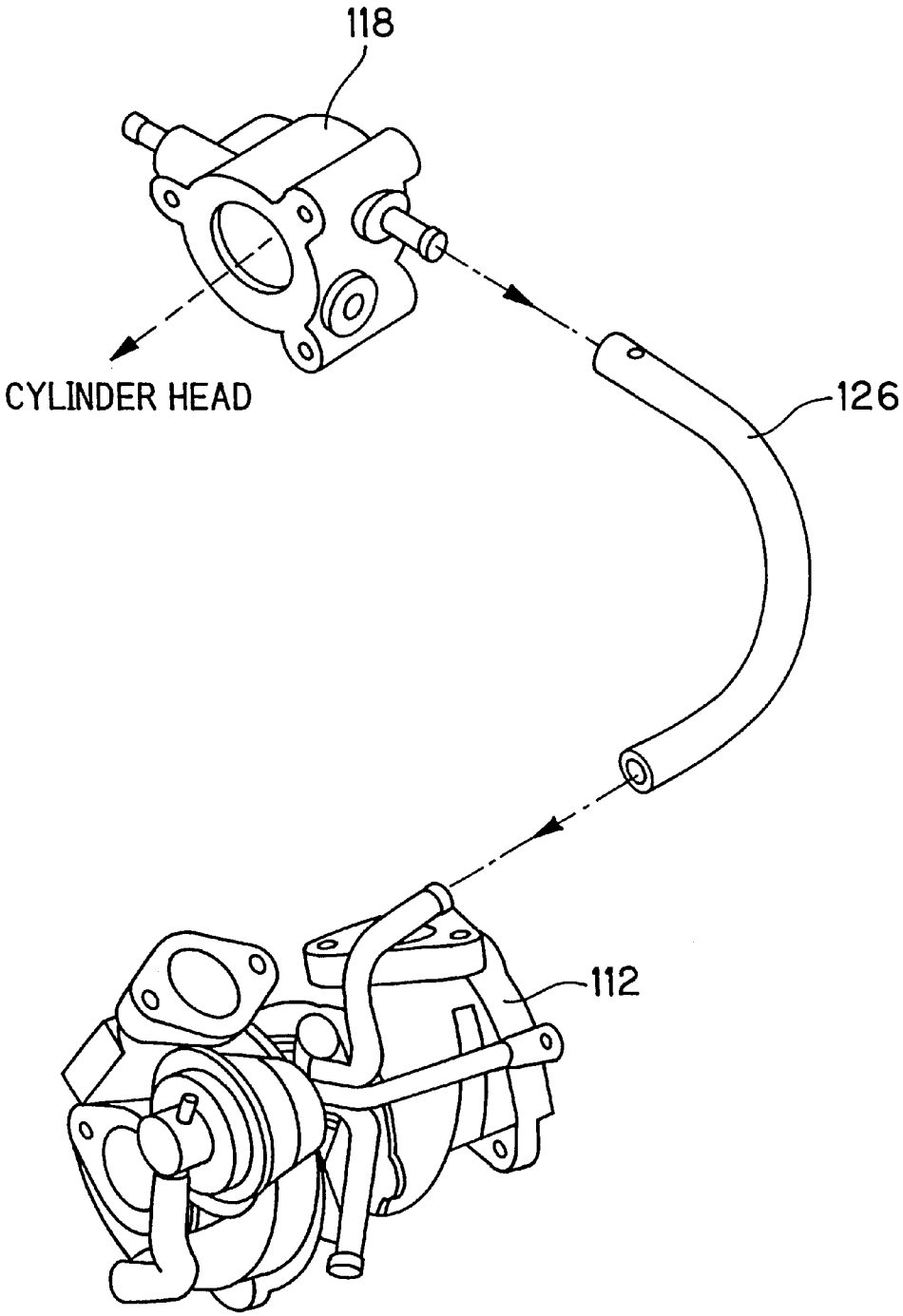
FIG. 12 (PRIOR ART)
FIG. 12 is a schematic perspective view showing an assembly of cooling piping in FIG. 11.
Figure 13:
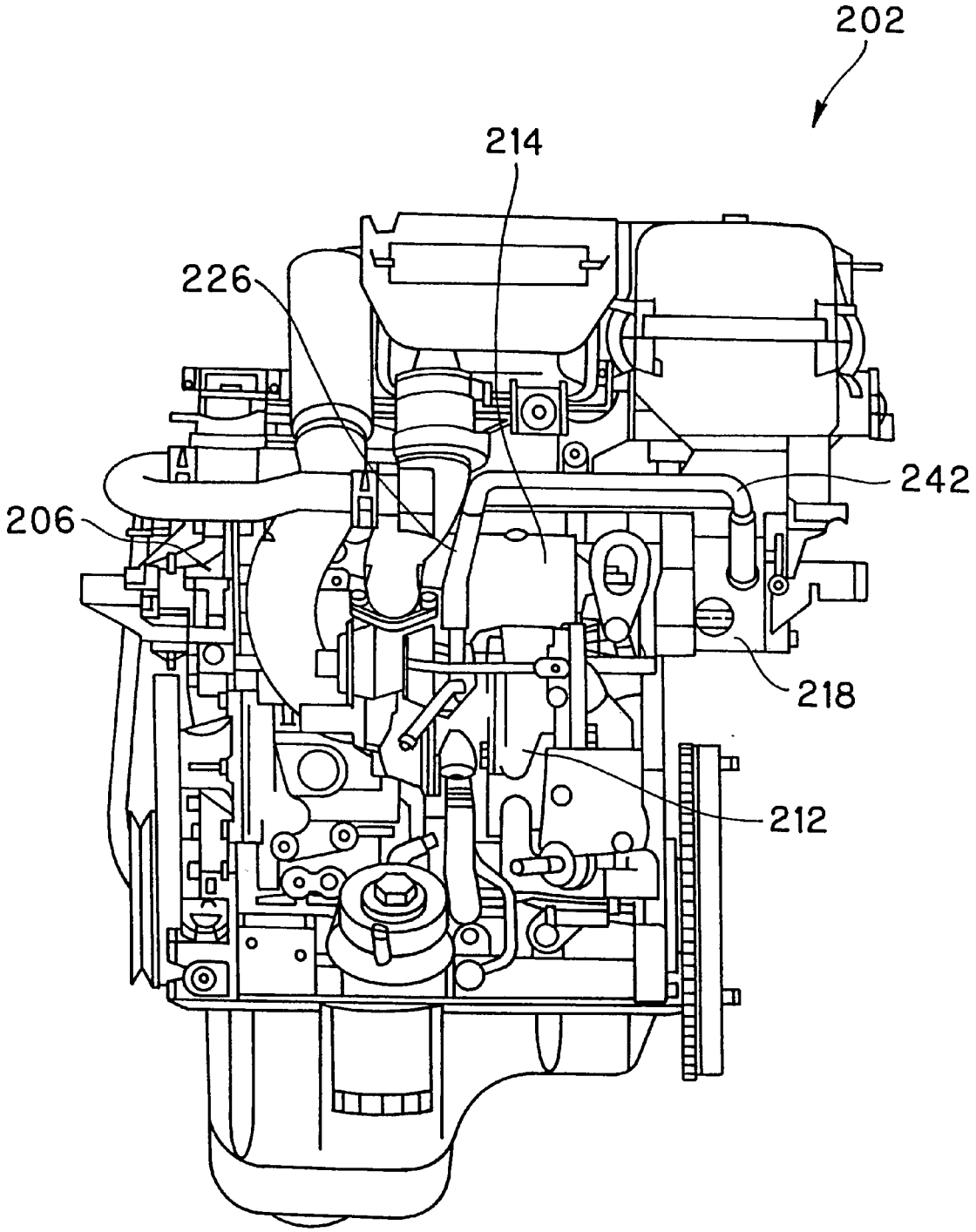
FIG. 13 (PRIOR ART)
FIG. 13 is a front view illustrating an engine with a supercharger according to a second example of the prior art that underlies the present invention; and, FIG. 14 is a schematic perspective view showing an assembly of cooling piping for the prior art engine of FIG. 13.
Figure 14:
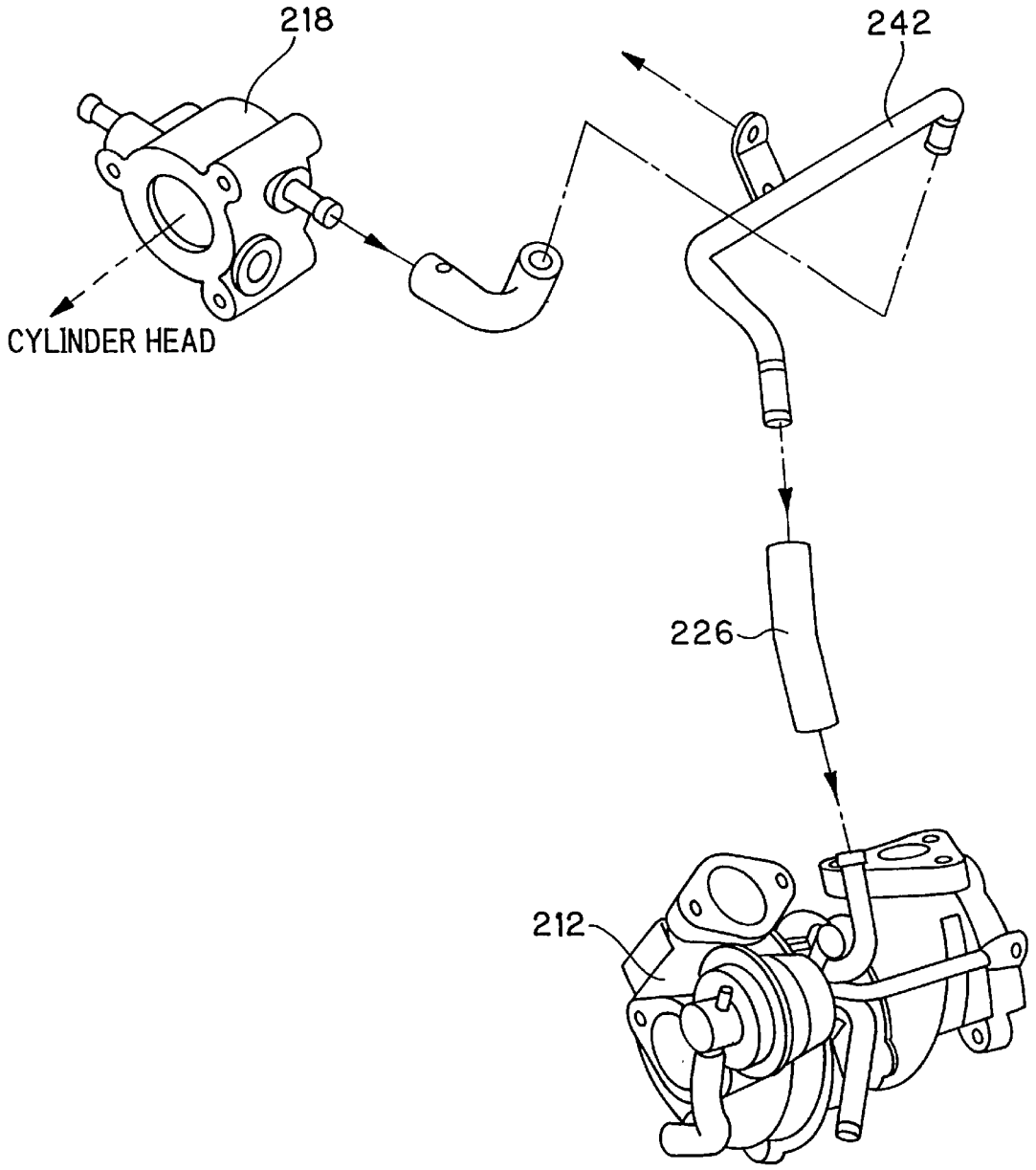
FIG.14 (PRIOR ART)

In one aspect of the present invention, the tank is positioned horizontally when being disposed substantially midway along the cooling piping. As illustrated in FIG. 10, a yet further alternative structure may be employed. More specifically, a tank 62 is slanted at a predetermined angle a such that the upstream side of the tank 62 is greater in height or raised higher in the upward direction, than the downstream side of the tank 62.

As a result, since the air (steam) generated in the supercharger during the engine-soaking period is collected at an upstream portion of the tank 62, the air is dislodged through the second pipe 30-3, thereby smoothly thrusting the cooling water out of the tank 62 into the supercharger 12. This contributes toward prevention against seizing of the supercharger 12. In addition, since it is only necessary to position the tank at a slant, settings need not be changed, and it is easy to practice.

As set forth earlier, the second pipe 30-3 of FIGS. 8–10 output cooling water to the supercharger and the inlet pipe 30-2 receives cooling water from the thermocase. The openings of the tanks in FIGS. 8–10 are all on the upward part of the respective tanks.

As detailed above, the present invention provides a cooling system for an engine 2, with a supercharger 12, including a main cooling system for cooling the engine and a sub-cooling system for use on the supercharger, the sub-cooling system being disposed alongside the main cooling system. The main improvement includes cooling piping 16 for cooling the supercharger 12 and a tank 30 for temporarily reserving cooling water. The tank is disposed substantially midway along the cooling piping 16 at a location above a position where the supercharger 12 is mounted. Then, the air (steam) generated in the supercharger 12 during the engine soaking period drives the cooling water out of the tank body portion into the supercharger. As a result, the supercharger 12 is positively prevented from experiencing seizing. Further, since the tank is disposed at an upper position of the cooling piping 16, the tank can reliably and easily be degassed. In addition, the tank 30 can contain a specified amount of cooling water.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a cooling system for an engine with a supercharger, including a main cooling system for cooling the engine and a sub-cooling system for use on the supercharger, the sub-cooling system being positioned alongside the main cooling system, the improvement comprising: said sub-cooling system including cooling piping connected to the supercharger for cooling the supercharger, and a tank for temporarily reserving cooling water, the tank being disposed substantially midway along the cooling piping at a location above a position where the supercharger is mounted, said tank further including a tank body portion, a first inlet side pipe connected to the tank body portion and the engine, and a second outlet side pipe connected to the tank body portion and the supercharger, the first and second pipes forming respective parts of the cooling piping such that said cooling water flows downstream from the engine through the tank body portion to the supercharger, the second outlet side pipe that is located toward the supercharger being mounted to a bottom portion of the tank body portion such that gas generated by said supercharger during engine shutdown is received in said tank body portion and displaces said cooling water out of said tank body portion to said supercharger.

2. A cooling system for an engine with a supercharger as defined in claim 1, wherein the tank is located at the topmost position of the cooling piping, and wherein the tank includes an opening for degassing.

3. A cooling system for an engine with a supercharger as defined in claim 1, wherein a height position of the tank body portion at an upper portion of the tank body portion is made smaller in stages from the first inlet side pipe toward the second outlet side pipe.

4. A cooling system for an engine with a supercharger as defined in claim 1, wherein the tank includes at least two tank body portions, in which a height position of each of the tank body portions is made smaller in stages from an inlet side of the tank toward an outlet side of the tank.

5. A cooling system for an engine with a supercharger as defined in claim 1, wherein the tank body portion is positioned at a downward slant from the first inlet side pipe toward the second outlet side pipe.

6. In a cooling system for an engine with a supercharger, including a main cooling system for cooling the engine and a sub-cooling system for use on the supercharger, the sub-cooling system being positioned along side the main cooling system, the sub-cooling system comprising:

a first inlet side pipe for connection to a thermal case of an engine;

a tank located at the topmost position of the sub-cooling system and having a first end and a second end, the tank receiving the first inlet side pipe at an upper position at the first end thereof; and an outlet side pipe connected to the second end of the tank at the bottommost portion thereof, the outlet side pipe arranged to provide cooling water to the supercharger.

7. A cooling system for an engine with a supercharger as defined in claim 6, wherein the tank is disposed at a location above the supercharger.

8. A cooling system for an engine with a supercharger as defined in claim 6, wherein the tank includes at least two tank body portions, wherein a height position of each of the tank body portions is made lower in stages from the inlet side of the tank toward the outlet side of the tank.

9. A cooling system for an engine with a supercharger, including a main cooling system for cooling the engine and a sub-cooling system for use on the supercharger, the sub-cooling system being positioned along side the main cooling system, the sub-cooling system comprising:

a first inlet side pipe for connection to a thermal case of an engine;

a tank having a first end and a second end, the tank receiving the first inlet side pipe at an upper position at the first end thereof;

a second outlet side pipe connected to the second end of the tank at the bottommost portion thereof, the outlet side pipe arranged to provide cooling water to the supercharger; and said tank being positioned at a downward slant from the first inlet side pipe toward the second outlet side pipe.

10. A cooling system for an engine with a supercharger, including a main cooling system for cooling the engine and a sub-cooling system for use on the supercharger, the sub-cooling system being positioned along side the main cooling system, the sub-cooling system comprising:

a first inlet side pipe for connection to a thermal case of an engine;

a tank having a first end and a second end, the tank receiving the first inlet side pipe at an upper position at the first end thereof; and an outlet side pipe connected to the second end of the tank at the bottommost portion thereof, the outlet side pipe arranged to provide cooling water to the supercharger;

wherein, during engine shutdown, steam generated by said supercharger travels from the supercharger through the outlet side pipe to the tank and, in response to receiving the steam, the tank returns coolant that is displaced by the steam to the supercharger through the outlet side pipe in a direction opposite to the direction of steam travel.

11. In a sub-cooling system for use with an engine having a supercharger and a main cooling system for cooling the engine, comprising the improvement wherein the sub-cooling system is arranged for cooling the supercharger during engine operation and shutdown, said sub-cooling system including:

a first inlet side pipe connected to the engine such that coolant is received from the engine;

a tank having an inlet connected to the first inlet side pipe;

a second outlet side pipe connected to an outlet of the tank and to the supercharger such that said coolant flows downstream from said tank to said supercharger during engine operation; and said tank being disposed in a location above said supercharger such that, during engine shutdown, gas generated in said supercharger travels upstream from said supercharger through said second outlet side pipe to the tank, said tank receiving and holding said gas therein wherein said gas moves said coolant downstream out of the tank to the supercharger through the second outlet side pipe to cool said supercharger during engine shutdown.

12. A sub-cooling system for an engine with a supercharger as defined in claim 11, wherein the tank is located at a topmost position of the sub-cooling system.

13. A sub-cooling system for an engine with a supercharger as defined in claim 11, wherein the first inlet side pipe is connected to a first end of the tank and the second outlet side pipe is connected to an opposite second end of the tank.

14. A sub-cooling system for an engine with a supercharger as defined in claim 13, wherein the tank includes a tank body portion, a height position of the tank body portion being made smaller in stages from the first inlet side pipe toward the second outlet side pipe.

15. A sub-cooling system for an engine with a supercharger as defined in claim 13, wherein the tank is located at a topmost position of the sub-cooling system.

16. A sub-cooling system for an engine with a supercharger as defined in claim 11, wherein the second outlet side pipe is located at a lower portion of the tank wherein said gas is held in an upper portion of said tank.

17. A sub-cooling system for an engine with a supercharger as defined in claim 16, wherein the first inlet side pipe is located at an upper position at the first end of the tank near the top of the tank.

18. A sub-cooling system for an engine with a supercharger as defined in claim 11, wherein the tank is positioned at a downward slant from the first inlet side pipe toward the second outlet side pipe.

* * * * *